US009234527B2

(12) United States Patent
Fukasaku et al.

(10) Patent No.: US 9,234,527 B2
(45) **Date of Patent: *Jan. 12, 2016**

(54) MOTOR DRIVEN COMPRESSOR

(71) Applicant: KABUSHIKI KAISHA TOYOTA JIDOSHOKKI, Kariya-shi, Aichi-ken (JP)

(72) Inventors: Hiroshi Fukasaku, Kariya (JP); Minoru Mera, Kariya (JP); Ken Suitou, Kariya (JP); Yumin Hishinuma, Kariya (JP); Takahiro Moroi, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 223 days.

This patent is subject to a terminal disclaimer.

(21) Appl. No.: 13/926,550

(22) Filed: Jun. 25, 2013

(65) Prior Publication Data

US 2014/0003974 A1 Jan. 2, 2014

(30) Foreign Application Priority Data

Jun. 28, 2012 (JP) ..... 2012-145746

(51) Int. Cl.
*F04D 29/58* (2006.01)
*F04B 35/04* (2006.01)
(Continued)

(52) U.S. Cl.
CPC ..... *F04D 29/5806* (2013.01); *F04B 35/04* (2013.01); *F04B 39/121* (2013.01); *F04B 39/14* (2013.01); *F04C 18/0215* (2013.01); *F04C 29/045* (2013.01); *F04B 2201/0801* (2013.01)

(58) Field of Classification Search
CPC . F04D 29/5806; F04D 29/045; F04B 39/121; F04B 39/14; F04B 35/04; F04B 2201/0801; F04C 39/121; F04C 18/0215; F04C 29/045; F04C 29/047
USPC ..... 417/366, 410.3, 371, 410.5
See application file for complete search history.

(56) References Cited

U.S. PATENT DOCUMENTS 6,042,346 A 3/2000 Doi
6,234,768 B1 * 5/2001 Harakawa et al. ..... 417/366
(Continued)

FOREIGN PATENT DOCUMENTS

EP 0 798 465 A1 10/1997
EP 1 378 666 A1 1/2004
(Continued)

OTHER PUBLICATIONS

Extended European Search Report dated Sep. 30, 2013, issued in corresponding European Patent Application No. 13173327.1.
(Continued)

*Primary Examiner* — Justin Jonaitis
*Assistant Examiner* — Stephen Mick
(74) *Attorney, Agent, or Firm* — Sughrue Mion, PLLC

(57) ABSTRACT

A motor-driven compressor includes a compression unit having a compression chamber, a rotation shaft, an electric motor having a coil, a motor driving circuit, a housing, and a shaft support. The coil includes a first coil end, which is relatively close to the motor driving circuit, and a second coil end, which is relatively close to the compression unit. The housing includes a first area and a second area. A refrigerant passage communicates the first area with the second area. The shaft support includes a guide wall that guides the refrigerant to flow along the radial outer surface of the second coil end. The refrigerant guided by the guide wall is drawn into the compression chamber from the second area through a first suction passage. The first suction passage and the refrigerant passage are arranged at opposite sides of the rotation shaft.

4 Claims, 3 Drawing Sheets

(51) Int. Cl.

| | |
|---|---|
| ***F04B 39/12*** | (2006.01) |
| ***F04B 39/14*** | (2006.01) |
| ***F04C 18/02*** | (2006.01) |
| ***F04C 29/04*** | (2006.01) |

(56) References Cited

U.S. PATENT DOCUMENTS

| | | | | |
|---|---|---|---|---|
| 8,152,490 | B2 | 4/2012 | Iguchi et al. | |
| 2002/0039532 | A1 | 4/2002 | Saito et al. | |
| 2004/0005229 | A1 | 1/2004 | Yoda | |
| 2009/0148314 | A1* | 6/2009 | Koitabashi et al. | 417/366 |
| 2009/0155101 | A1* | 6/2009 | Fukasaku et al. | 417/410.1 |
| 2009/0162221 | A1 | 6/2009 | Iguchi et al. | |
| 2009/0162222 | A1 | 6/2009 | Iguchi et al. | |
| 2009/0162233 | A1* | 6/2009 | Shimaguchi et al. | 418/186 |
| 2009/0269222 | A1 | 10/2009 | Fukasaku et al. | |
| 2011/0058973 | A1* | 3/2011 | Yamada et al. | 418/55.1 |
| 2013/0004345 | A1* | 1/2013 | Horiba et al. | 417/411 |

FOREIGN PATENT DOCUMENTS

| | | | |
|---|---|---|---|
| EP | 2 072 821 | A2 | 6/2009 |
| EP | 2 540 960 | A2 | 1/2013 |
| JP | 62-126285 | A | 6/1987 |
| JP | 9-32729 | A | 2/1997 |
| JP | 2002-174178 | A | 6/2002 |
| JP | 2002-188575 | A | 7/2002 |
| JP | 2005-201108 | A | 7/2005 |
| JP | 2007-162661 | A | 6/2007 |
| JP | 2008-042956 | A | 2/2008 |
| JP | 2008-82279 | A | 4/2008 |
| JP | 2008-138532 | A | 6/2008 |
| JP | 2008-184995 | A | 8/2008 |
| JP | 2009-150234 | A | 7/2009 |
| JP | 2009-150237 | A | 7/2009 |
| JP | 2009-250173 | A | 10/2009 |
| JP | 2009-264279 | A | 11/2009 |

OTHER PUBLICATIONS

Communication dated May 26, 2015 from the Japanese Patent Office in counterpart application No. 2012-145746.

Communication dated Sep. 23, 2014 from the Korean Intellectual Property Office in counterpart application No. 10-2013-0070203.

* cited by examiner

MOTOR DRIVEN COMPRESSOR

BACKGROUND OF THE INVENTION

The present invention relates to a motor-driven compressor that includes a compression unit, an electric motor, and a motor driving circuit, which are arranged in this order along the axial direction of a rotation shaft.

Japanese Laid-Open Patent Publication No. 2005-201108 discloses a motor-driven compressor. The motor-driven compressor includes a housing accommodating an electric motor and a scroll compression unit. The electric motor drives the compression unit that compresses a fluid (refrigerant). The housing includes a first fluid passage located between the outer surface of the electric motor and the inner surface of the housing. The housing also includes a partition that separates the electric motor from the fluid and guides the fluid to the first fluid passage. The partition guides the fluid drawn into the housing near the electric motor to the first fluid passage. The fluid flowing in the first fluid passage absorbs heat from the electric motor.

In the motor-driven compressor, the compression unit, electric motor, and motor driving circuit are arranged along the axial direction of the rotation shaft. This increases the overall axial size of the motor-driven compressor. The axial size can be reduced by reducing the size of the electric motor, for example. However, to maintain the performance of the electric motor while reducing the size, a large amount of current needs to be applied to coils that are wound around teeth of a stator core that the electric motor includes. This increases the heat generated by the coils. Each coil includes an end located near the compression unit. Thus, the compression unit may heat the ends of the coils to a high temperature.

SUMMARY OF THE INVENTION

It is an object of the present invention to provide a motor-driven compressor that effectively cools a coil end of an electric motor located near a compression unit.

To achieve the above object, one aspect of the present invention is a motor-driven compressor includes a compression unit that includes a compression chamber and compresses refrigerant in the compression chamber, a rotation shaft that rotates to drive the compression unit, an electric motor that drives the rotation shaft and includes a stator core, which includes teeth, and a coil, which is wound around the teeth, a motor driving circuit that drives the electric motor, a housing accommodating the compression unit, the electric motor, and the motor driving circuit, which are arranged in this order along an axial direction of the rotation shaft, and a shaft support that is arranged between the electric motor and the compression unit and rotatably supports the rotation shaft. The stator core is fixed to the housing. The coil includes a first coil end, which is relatively close to the motor driving circuit, and a second coil end, which is relatively close to the compression unit. The housing includes a first area, which accommodates the first coil end, and a second area, which accommodates the second coil end. The housing includes a suction port that opens to the first area and is connected to an external refrigerant circuit. A refrigerant passage is formed between the stator core and the housing and communicates the first area with the second area. The second coil end includes an axial end surface and a radial outer surface. The shaft support includes a guide wall that faces the axial end surface of the second coil end and guides the refrigerant flowing into the second area from the refrigerant passage so that the refrigerant flows along the radial outer surface of the second coil end.

A first suction passage is arranged in the housing. The refrigerant guided by the guide wall is drawn into the compression chamber from the second area through the first suction passage. The first suction passage and the refrigerant passage are arranged at opposite sides of the rotation shaft.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
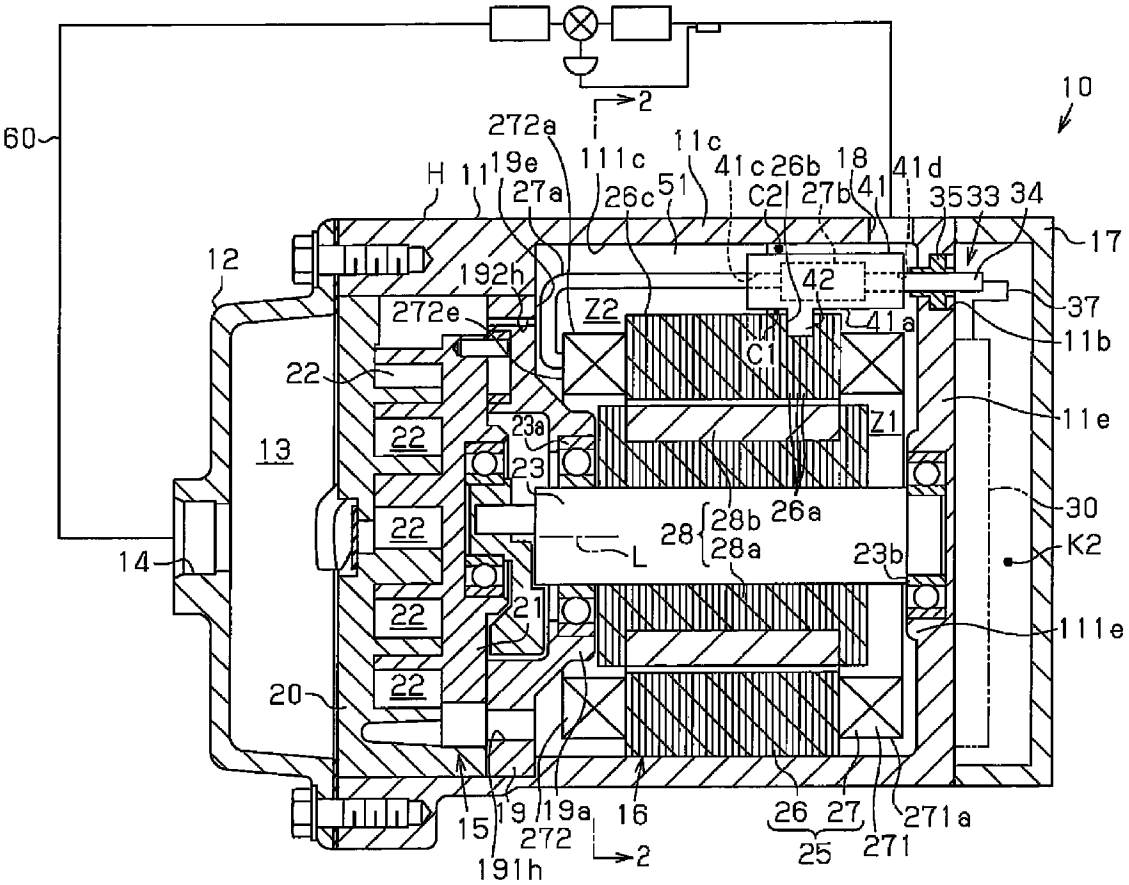
FIG. 1 is a cross-sectional side view showing a motor-driven compressor of one embodiment.
Figure 2:
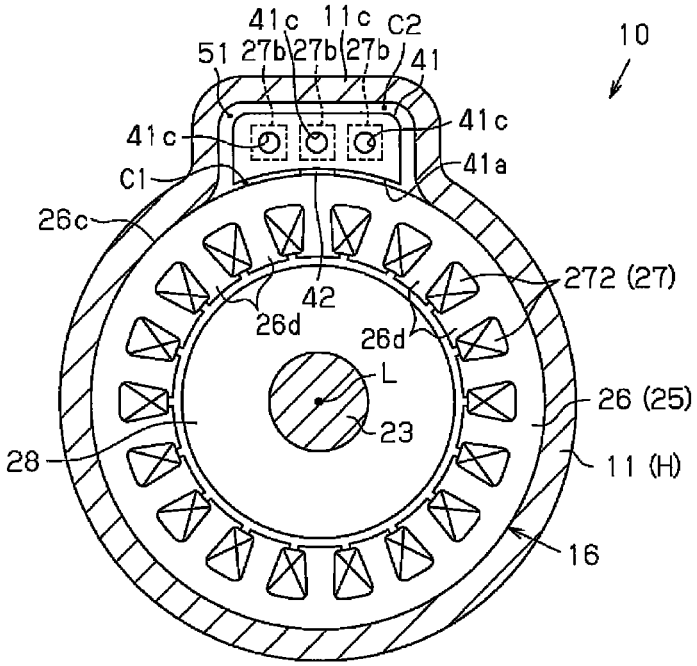
FIG. 2 is a cross-sectional view taken along line 2-2 in FIG. 1.

Referring to FIGS. 1 and 2, one embodiment of a motor-driven compressor for a vehicle air-conditioning device will now be described.

As shown in FIG. 1, a motor-driven compressor 10 includes a housing H that includes a motor housing member 11 and a discharge housing member 12. The motor housing member 11 is made of metal (aluminum in the present embodiment), cylindrical, and has one closed end. The discharge housing member 12 is connected to the open end (left end as indicated in FIG. 1) of the motor housing member 11. The discharge housing member 12 is made of metal (aluminum in the present embodiment), cylindrical, and has one closed end. The discharge housing member 12 forms a discharge chamber 13. The motor housing member 11 includes an end wall 11*e* connected to an inverter cover 17. The inverter cover 17 is made of metal (aluminum in the present embodiment), cylindrical, and has one closed end.

The motor housing member 11 accommodates a rotation shaft 23, a compression unit 15, which compresses a refrigerant, and an electric motor 16, which drives the compression unit 15. The compression unit 15 and electric motor 16 are arranged next to each other along the axis L of the rotation shaft 23 (along the axial direction of the rotation shaft 23). The electric motor 16 is closer to the end wall 11*e* of the motor housing member 11 (right side as viewed in FIG. 1) than the compression unit 15. In addition, the end wall 11*e* of the motor housing member 11 and the inverter cover 17 define a cavity to accommodate a motor driving circuit 30 that drives the electric motor 16 as indicated by the double-dashed lines in FIG. 1. The motor driving circuit 30 is in close contact with and thermally coupled to the end wall 11*e*. In the present embodiment, the compression unit 15, the electric motor 16, and the motor driving circuit 30 are arranged in this order along the axis L of the rotation shaft 23.

The compression unit 15 includes a fixed scroll 20, which is fixed in the motor housing member 11, and a movable scroll 21, which is engaged with the fixed scroll 20. The fixed scroll 20 and the movable scroll 21 form a compression chamber 22 that has a variable volume. A cylindrical shaft support 19, which supports one end of the rotation shaft 23, is arranged between the electric motor 16 and the compression unit 15 in the motor housing member 11. The shaft support 19 includes a bearing holding portion 19*a*. The bearing holding portion 19*a* holds a radial bearing 23*a* that rotatably supports one end of the rotation shaft 23. In addition, the end wall 11*e* includes a shaft supporting portion 111*e*. The shaft supporting portion 111*e* holds a radial bearing 23*b* that rotatably supports the other end of the rotation shaft 23. The rotation shaft 23 is supported by the radial bearings 23*a* and 23*b* to be rotatable relative to the shaft support 19 and the end wall 11*e* of the motor housing member 11.

A stator 25 is fixed to the inner circumferential surface of the motor housing member 11. The stator 25 includes an annular stator core 26 and coils 27. The stator core 26 is fixed to the inner circumferential surface of the motor housing member 11 and includes teeth 26*d* (see FIG. 2). The coils 27 are wound around the teeth 26*d*. Each coil 27 includes a first end 271, which is relatively close to the motor driving circuit 30, and a second end 272, which is relatively close to the compression unit 15. In the description below, the first end 271 of the coil 27 is also referred to as a first coil end 271, and the second end 272 is also referred to as a second coil end 272. The stator core 26 includes a plurality of laminated magnetic core plates 26*a* (electromagnetic metal plates). The stator core 26 has an outer circumferential surface 26*c* including an insertion recess 26*b*. The insertion recess 26*b* is formed by cutting out parts from the outer circumferences of some of the core plates 26*a* (four plates in the present embodiment). A rotor 28 is arranged in the stator 25. The rotor 28 includes a rotor core 28*a*, which is fixed to the rotation shaft 23, and a plurality of permanent magnets 28*b* arranged on the periphery of the rotor core 28*a*.

The motor housing member 11 has an upper part including a passage-forming portion 11*c* that projects radially outward. The passage-forming portion 11*c* extends linearly along the axis L of the rotation shaft 23 and has an inner surface 111*c*. The inner surface 111*c* and the outer circumferential surface 26*c* of the stator core 26 define a refrigerant passage 51 in the passage-forming portion 11*c*. The present embodiment includes only one refrigerant passage 51. The motor housing member 11 also includes a suction port 18. The suction port 18 opens to a first area Z1 that accommodates the first coil ends 271. The suction port 18 is located above the rotation shaft 23 in a gravitational direction and connected to an external refrigerant circuit 60. In addition, the discharge housing member 12 has an end wall (left end as viewed in FIG. 1) including a discharge port 14. The discharge port 14 is connected to the external refrigerant circuit 60.

The refrigerant passage 51 connects the first area Z1 to a second area Z2 of the motor housing member 11 that accommodates the second coil ends 272. The first area Z1 is a cavity defined by the end wall 11*e* and first end surfaces of the stator core 26 and the rotor core 28*a* that face the end wall 11*e*. The first area Z1 accommodates the entire first coil ends 271. The second area Z2 is a cavity defined by the shaft support 19 and second end surfaces of the stator core 26 and the rotor core 28*a* that face the shaft support 19. The second area Z2 accommodates the entire second coil ends 272.

As shown in FIG. 2, the refrigerant passage 51 accommodates a rectangular cluster block 41, which is made of a synthetic resin. The cluster block 41 accommodates connection terminals 27*b*. The cluster block 41 includes an outer bottom surface 41*a*, which is arcuate in conformance with the outer circumferential surface 26*c* of the stator core 26 and extends along the axial direction of the stator core 26.

As shown in FIG. 1, the outer bottom surface 41*a* of the cluster block 41 includes a coupling boss 42. The coupling boss 42 is fitted to the insertion recess 26*b* to couple the cluster block 41 to the outer circumferential surface 26*c* of the stator core 26. When the cluster block 41 is coupled to the outer circumferential surface 26*c* of the stator core 26, a gap C1 is formed between the outer bottom surface 41*a* of the cluster block 41 and the outer circumferential surface 26*c* of the stator core 26, and a gap C2 is formed between the cluster block 41 and the inner surface 111*c* of the passage-forming portion 11*c*.

Leads 27*a* of U, V, and W phases (only one lead shown in FIG. 1) extend from the second coil ends 272 toward the refrigerant passage 51. The leads 27*a* extend through first insertion bores 41*c* of the cluster block 41 and are connected to the connection terminals 27*b*. Accordingly, the leads 27*a* partially extend through the refrigerant passage 51.

The end wall 11*e* of the motor housing member 11 includes a through hole 11*b*, which receives a sealing terminal 33. The sealing terminal 33 includes three sets of a metal terminal 34 and a glass insulator 35 (only one set shown in FIG. 1). The metal terminals 34 are electrically connected to the motor driving circuit 30. Each glass insulator 35 fixes the corresponding metal terminal 34 to the end wall 11*e* and insulates the metal terminal 34 from the end wall 11*e*. Each metal terminal 34 has a first end electrically connected to the motor driving circuit 30 by a cable 37. Each metal terminal 34 extends toward the refrigerant passage 51 and has a second end that is inserted into the cluster block 41 through a second insertion bore 41*d* of the cluster block 41 and electrically connected to the corresponding connection terminal 27*b*.

The shaft support 19 includes a guide wall 19*e* on the side that faces the second area Z2. The guide wall 19*e* generally faces axial end surfaces 272*e* of the second coil ends 272. Part of the guide wall 19*e* projects into the second coil ends 272. Accordingly, the bearing holding portion 19*a* is located in the second coil ends 272 and is surrounded by the second coil ends 272. The portion of the guide wall 19*e* that directly faces the end surfaces 272*e* of the second coil ends 272 is located adjacent to the end surfaces 272*e*.

The shaft support 19 has a peripheral portion with a lower section including a first through hole 191*h*. The first through hole 191*h* is in communication with the space located at the outer side of the movable scroll 21. In addition, the first through hole 191*h* communicates the compression chamber 22 with a portion of the second area Z2 that is below the rotation shaft 23 in the gravitational direction. The refrigerant flowing through the second area Z2 below the rotation shaft 23 is drawn into the compression chamber 22 through the first through hole 191*h*. In the present embodiment, the first through hole 191*h* functions as a first suction passage.

The peripheral portion of the shaft support 19 has an upper section including a second through hole 192*h*. The second through hole 192*h* is in communication with the space located outside the movable scroll 21. The through hole 192*h* communicates the compression chamber 22 with the upper portion of the second area Z2. The refrigerant flowing into the second area Z2 from the outlet of the refrigerant passage 51 is drawn into the compression chamber 22 through the second through hole 192*h*. In the present embodiment, the second through hole 192*h* functions as a second suction passage.

The outlet of the refrigerant passage 51 and the first through hole 191*h* are arranged at the opposite sides of the rotation shaft 23, and the refrigerant passage 51 and the second through hole 192*h* are arranged at the opposite sides of the rotation shaft 23.

The first through hole 191*h* has a larger passage area than the second through hole 192*h*. Thus, the refrigerant flowing in the second area Z2 is more likely to be drawn into the first through hole 191*h* than into the second through hole 192*h*.

Accordingly, more refrigerant flows through the first through hole 191*h* than the second through hole 192*h*.

The operation of the present embodiment will now be described.

In the motor-driven compressor 10, when power, which is controlled by the motor driving circuit 30, is supplied to the electric motor 16, the rotor 28 and the rotation shaft 23 rotate at a controlled rotation speed. This decreases the volume of the compression chamber 22 formed by the fixed scroll 20 and the movable scroll 21 in the compression unit 15. The refrigerant is drawn in the first area Z1 of the motor housing member 11 from the external refrigerant circuit 60 through the suction port 18. The refrigerant drawn in the first area Z1 is divided into the refrigerant that is guided by the end wall 11*e* and flows along the radial outer surfaces 271*a* of the first coil ends 271 and the refrigerant that flows to the second area Z2 through the refrigerant passage 51. Here, the refrigerant passage 51 functions as a main refrigerant passage for the refrigerant flowing from the first area Z1 to the second area Z2.

Each first coil end 271 is cooled by the refrigerant flowing along the radial outer surfaces 271*a* of the first coil ends 271. The refrigerant guided by the end wall 11*e* flows along the radial outer surfaces 271*a* of the first coil ends 271. Thus, the refrigerant cools the end wall 11*e* and the motor driving circuit 30, which is thermally coupled to the end wall 11*e*.

The refrigerant flowing into the second area Z2 through the outlet of the refrigerant passage 51 is divided into the refrigerant that is drawn into the compression chamber 22 through the second through hole 192*h* and the refrigerant that is guided by the guide wall 19*e* and flows along the radial outer surfaces 272*a* of the second coil ends 272. The refrigerant sent to the compression chamber 22 through the second through hole 192*h* is compressed in the compression chamber 22 and discharged into the discharge chamber 13.

The first through hole 191*h* has a larger passage area than the second through hole 192*h*. Thus, the refrigerant flowing through the second area Z2 is more likely to be drawn into the first through hole 191*h* than into the second through hole 192*h*. Accordingly, the amount of refrigerant that is guided by the guide wall 19*e* and flows along the radial outer surfaces 272*a* of the second coil ends 272 is greater than the amount of the refrigerant that flows toward the second through hole 192*h*.

The refrigerant flowing along the radial outer surfaces 272*a* of the second coil ends 272 cools the second coil ends 272. Here, the portion of the shaft support 19 that projects into the second coil ends 272 limits the flow of refrigerant into the second coil ends 272. This further enhances the flow of refrigerant along the radial outer surfaces 272*a* of the second coil ends 272. After flowing along the radial outer surfaces 272*a*, the refrigerant is drawn into the compression chamber 22 from the portion of the second area Z2 that is located below the rotation shaft 23 in the gravitational direction through the first through hole 191*h*. The refrigerant is compressed in the compression chamber 22 and then discharged into the discharge chamber 13. The discharged refrigerant in the discharge chamber 13 flows through the discharge port 14 into the external refrigerant circuit 60 and returns to the motor housing member 11.

The advantages of the present embodiment will now be described.

(1) The refrigerant passage 51, which communicates the first and second areas Z1 and Z2, is arranged between the stator core 26 and the motor housing member 11. In addition, the shaft support 19 includes the guide wall 19*e* that guides the refrigerant flowing into the second area Z2 from the outlet of the refrigerant passage 51 so that the refrigerant flows along the radial outer surfaces 272*a* of the second coil ends 27. Further, the refrigerant guided by the guide wall 19*e* is drawn into the compression chamber 22 from the second area Z2 through the first through hole 191*h*. Accordingly, the refrigerant that is drawn into the first area Z1 through the suction port 18 flows at least along the radial outer surfaces 272*a* of the second coil ends 272 before being sent to the compression chamber 22. The refrigerant thus effectively cools the second coil ends 272.

(2) The motor-driven compressor 10 includes the second through hole 192*h* in addition to the first through hole 191*h*. The second through hole 192*h* and the first through hole 191*h* are located at opposite sides of the rotation shaft 23. The first through hole 191*h* has a larger passage area than the second through hole 192*h*. Accordingly, the amount of the refrigerant sent to the compression chamber 22 through the first through hole 191*h* after flowing along the radial outer surfaces 272*a* of the second coil ends 272 is greater than the refrigerant that is sent to the compression chamber 22 through the second through hole 192*h* without flowing along the radial outer surfaces 272*a*. The refrigerant thus effectively cools the second coil ends 272. Further, in addition to the first through hole 191*h*, the refrigerant is sent to the compression chamber 22 through the second through hole 192*h*. This allows for efficient suction of refrigerant into the compression chamber 22. A structure including the two suction passages of the first and second through holes 191*h* and 192*h* is suitable for scroll compressors such as that of the present embodiment.

(3) The electric motor 16 and the compression unit 15 are arranged next to each other in the motor-driven compressor 10, and the first through hole 191*h* is in communication with the portion of the second area Z2 located below the rotation shaft 23 in the gravitational direction. The first through hole 191*h* communicates the compression chamber 22 with the portion of the second area Z2 below the rotation shaft 23 in the gravitational direction. Thus, lubricant oil from the refrigerant collected in the second area Z2 below the rotation shaft 23 and a liquid mixture of the lubricant oil and the liquefied refrigerant remaining in the second area Z2 below the rotation shaft 23 in the gravitational direction are drawn into the compression chamber 22 through the first through hole 191*h*. This avoids accumulation of the lubricant oil and the liquid mixture in the second area Z2 below the rotation shaft 23. Since the coils are not immersed in lubricant oil and liquid mixture, current leakage is suppressed.

(4) The cluster block 41, which electrically connects the electric motor 16 and the motor driving circuit 30, is arranged in the refrigerant passage 51. Thus, the refrigerant flowing through the refrigerant passage 51 cools the cluster block 41.

(5) The guide wall 19*e* partially projects toward into the second coil ends 272 so that the bearing holding portion 19*a* is surrounded by the second coil ends 272. The portion of the guide wall 19*e* projecting into the second coil ends 272 obstructs the flow of refrigerant into the second coil ends 272. This allows the refrigerant to flow further smoothly along the radial outer surfaces 272*a* of the second coil ends 272. In addition, the second coil ends 272 surrounds the bearing holding portion 19*a*. This reduces the size of the motor-driven compressor 10 in the axial direction of the rotation shaft 23 as compared to a compressor structure in which the bearing holding portion 19*a* is located at the outer side of the end surfaces 272*e* of the second coil ends 272.

(6) The present embodiment effectively cools the first coil ends 271 with the refrigerant that is guided by the end wall 11*e* and flows along the radial outer surfaces 271*a* of the first coil ends 271.

(7) In the present embodiment, the refrigerant that is guided by the end wall 11*e* and flows along the radial outer surfaces 271*a* of the first coil ends 271 cools the end wall 11*e*. This allows for cooling of the motor driving circuit 30, which is thermally coupled to the end wall 11*e*.

(8) The present embodiment includes only one refrigerant passage 51 between the first and second areas Z1 and Z2. Accordingly, the refrigerant passage 51 serves as the main refrigerant passage and receives a large portion of refrigerant from the suction port 18 and the first area Z1. Thus, a large portion of refrigerant flows along the radial outer surfaces 272*a* of the second coil ends 272 after flowing through the refrigerant passage 51. This effectively cools the second coil ends 272.

It should be apparent to those skilled in the art that the present invention may be embodied in many other specific forms without departing from the spirit or scope of the invention. Particularly, it should be understood that the present invention may be embodied in the following forms.

Figure 3:
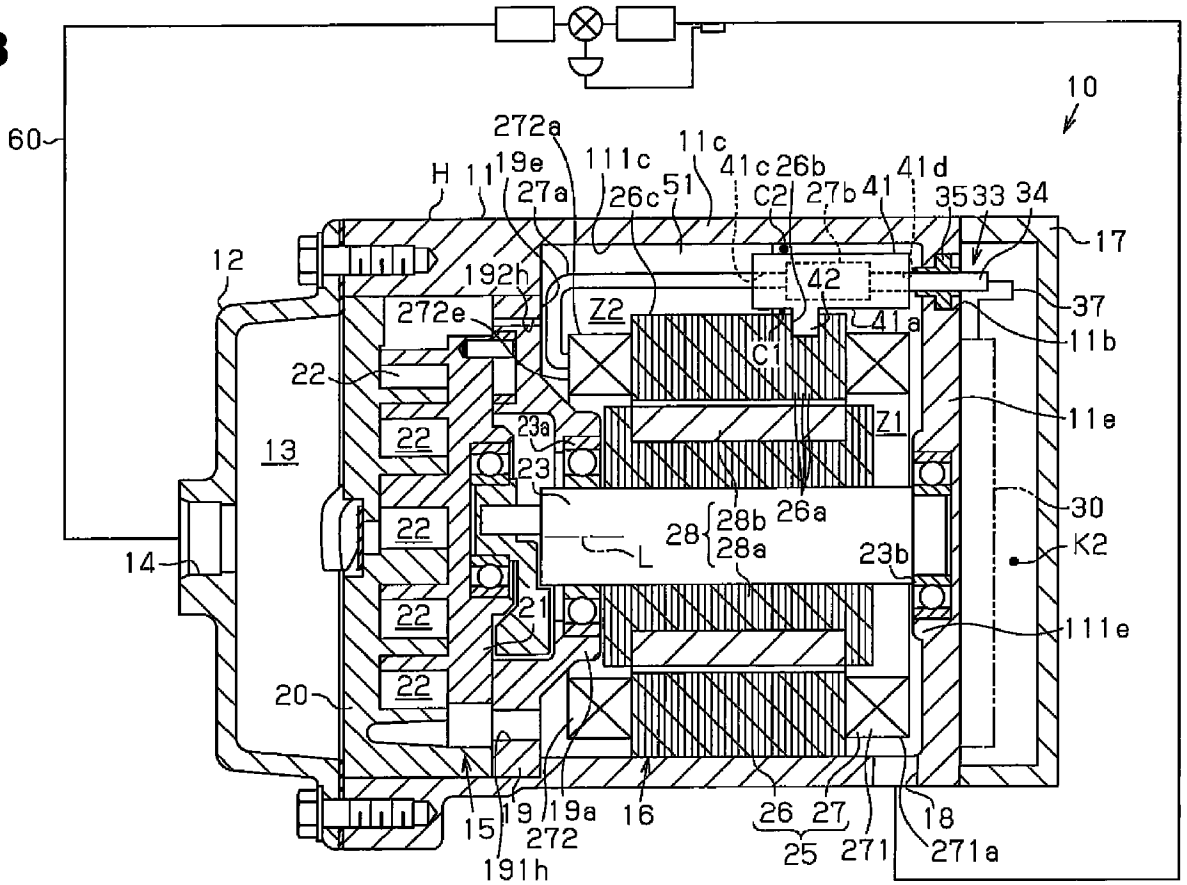
FIG. 3 is a cross-sectional side view showing a motor-driven compressor of another embodiment.

As shown in FIG. 3, the suction port 18 and the refrigerant passage 51 may be arranged at opposite sides of the rotation shaft 23. The suction port 18 is arranged in the motor housing member 11 below the rotation shaft 23 in the gravitational direction and opens to the first area Z1. In this embodiment, the refrigerant that is drawn into the first area Z1 through the suction port 18 flows along the radial outer surfaces 271*a* of the first coil ends 271 toward the refrigerant passage 51. The refrigerant then flows into the second area Z2 through the refrigerant passage 51 and is guided by the guide wall 19*e* to flow along the radial outer surfaces 272*a* of the second coil ends 272. The refrigerant thus effectively cools the first coil ends 271 and the second coil ends 272.

In the present embodiment, the entire suction port 18 opens to the first area Z1. However, the suction port 18 may only partially open to the first area Z1.

The first and second through holes 191*h* and 192*h* may be formed in the motor housing member 11.

The inlet of the refrigerant passage 51 may be located in the first area Z1 below the rotation shaft 23 in the gravitational direction, and the outlet of the refrigerant passage 51 may be located in the second area Z2 above the rotation shaft 23.

More than one passage may be arranged between the first and second areas Z1 and Z2 provided that the refrigerant passage 51 receives the largest portion of the refrigerant that is drawn in the first area Z1 through the suction port 18 and flows to the second area Z2.

More than one passage may guide the refrigerant in the second area Z2 to the compression chamber 22 provided that the first through hole 191*h* has a larger passage area than other passages.

The second through hole 192*h* may be omitted.

The cluster block 41 does not have to be coupled to the outer circumferential surface 26*c* of the stator core 26.

The cluster block 41 does not have to be arranged in the refrigerant passage 51.

In the motor housing member 11, the electric motor 16 and the compression unit 15 may be tilted in the vertical direction at an angle of 10° relative to a horizontal axis and arranged next to each other.

In the motor housing member 11, the electric motor 16 and the compression unit 15 may be arranged vertically along a line perpendicular to the horizontal axis.

The motor driving circuit 30 may be coupled to the inverter cover 17 in the cavity defined by the end wall 11*e* of the motor housing member 11 and the inverter cover 17. Since the end wall 11*e* and the inverter cover 17 are thermally coupled, the end wall 11*e* cooled by the refrigerant cools the inverter cover 17. Thus, the motor driving circuit 30 is cooled.

The guide wall 19*e* does not have to include a portion that projects into the second coil ends 272, and the bearing holding portion 19*a* does not have to be located in the second coil ends 272. That is, the bearing holding portion 19*a* may be located outside the end surfaces 272*e* of the second coil ends 272.

The compression unit 15 may be of a piston type or a vane type.

Therefore, the present examples and embodiments are to be considered as illustrative and not restrictive and the invention is not to be limited to the details given herein, but may be modified within the scope and equivalence of the appended claims.

The invention claimed is:

1. A motor-driven compressor comprising:

a compression unit that includes a compression chamber and compresses refrigerant in the compression chamber;

a rotation shaft that rotates to drive the compression unit;

an electric motor that drives the rotation shaft and includes a stator core, which includes teeth, and a coil, which is wound around the teeth;

a motor driving circuit that drives the electric motor;

a housing accommodating the compression unit, the electric motor, and the motor driving circuit, which are arranged in this order along an axial direction of the rotation shaft; and a shaft support that is arranged between the electric motor and the compression unit and rotatably supports the rotation shaft, wherein the stator core is fixed to the housing, the coil includes a first coil end and a second coil end, the first coil end closer to the motor driving circuit than the second coil end, and the second coil end, closer to the compression unit than the first coil end the housing includes a first area, which accommodates the first coil end, and a second area, which accommodates the second coil end, the housing includes a suction port that opens to the first area and is connected to an external refrigerant circuit, a refrigerant passage is formed between the stator core and the housing and communicates the first area with the second area, the second coil end includes an axial end surface and a radial outer surface, the shaft support includes a guide wall that faces the axial end surface of the second coil end and is configured to guide the refrigerant flowing into the second area from the refrigerant passage so that the refrigerant flows along the radial outer surface of the second coil end, the shaft support includes a bearing holding portion that holds a bearing, which rotatably supports the rotation shaft, a portion of the guide wall projects into the second coil end so that the bearing holding portion is surrounded by the second coil end;

a first suction passage and a second suction passage are arranged in the housing, the refrigerant guided by the guide wall is drawn into the compression chamber from the second area through the first suction passage, the second suction passage is configured to draw the refrigerant from the refrigerant passage flowing through the second area into the compression chamber together with the first suction passage, the first suction passage and the refrigerant passage are arranged at opposite sides of the rotation shaft, second suction passage and the first suction passage are arranged at opposite sides of the rotation shaft, and the first suction passage has a larger passage area than the second suction passage.

2. The motor-driven compressor according to claim 1, wherein the electric motor and the compression unit are arranged next to each other, and the first suction passage is in communication with a portion of the second area that is located below the rotation shaft and on the opposite side of the rotation shaft from the refrigerant passage.

3. The motor-driven compressor according to claim 1, further comprising a cluster block that is arranged in the refrigerant passage and electrically connects the electric motor to the motor driving circuit.

4. The motor-driven compressor according to claim 1, wherein the suction port and the refrigerant passage are arranged at opposite sides of the rotation shaft.

* * * * *